US005383816A

United States Patent [19]

Marcello et al.

[11] Patent Number: 5,383,816

[45] Date of Patent: Jan. 24, 1995

[54] EXHAUST BOX

[75] Inventors: Dominic Marcello, Mississauga; Michael DiMauro, Concord, both of Canada

[73] Assignee: Webb Industries, Concord, Canada

[21] Appl. No.: 56,748

[22] Filed: May 4, 1993

[51] Int. Cl.[6] ..... F24F 13/10

[52] U.S. Cl. ..... 454/359; 454/363

[58] Field of Search ..... 454/358, 359, 361, 363, 454/367

[56] References Cited

U.S. PATENT DOCUMENTS

| | | | |
|---|---|---|---|
| 2,052,315 | 8/1936 | Riesner | 454/367 |
| 2,628,551 | 2/1953 | Leigh | 454/367 X |
| 2,754,748 | 7/1956 | Daggett | 454/359 |
| 2,770,833 | 11/1956 | Drechsel | 454/359 X |
| 3,285,155 | 11/1966 | Malfenport | 454/359 |
| 3,842,722 | 10/1974 | Miller | 454/359 |
| 3,866,950 | 2/1975 | Skoch et al. | 454/292 X |
| 5,014,610 | 5/1991 | Twito | 454/330 X |

*Primary Examiner*—Harold Joyce

*Attorney, Agent, or Firm*—Donald E. Hewson

[57] ABSTRACT

An exhaust box used to ventilate rooms or devices within a building to the ambient environment. The exhaust box has a generally rectangular main body portion, with an exterior end and an interior end and is adapted for installation in the wall structure of the building. An inlet portion projects from the interior end and is adapted to receive an exhaust duct in sealed relation thereto. A flange portion extending radially outwardly from the exterior end of the main body portion helps retain the exhaust box in place within the wall structure. The main body portion has a bottom portion that is sloped downwardly towards the exterior end so as to cause water to flow towards the exterior thereof. A damper member is pivotally attached to the exhaust box so as to be gravity biased into place against a receiving surface at the interior end of the inlet portion. The damper member allows exhaust air to flow through the inlet portion, to thereby be exhausted to the exterior of the wall structure, and also causes the inlet portion to be closed off when no exhaust air is flowing therethrough. A removably attachable rain screen grill, which precludes the entry of rain into the exhaust box, extends outwardly from the exterior end of the main body portion. The bottom of the rain screen grill is trough shaped and has perforations therein so as to allow for drainage of water therefrom.

10 Claims, 4 Drawing Sheets

EXHAUST BOX

FIELD OF THE INVENTION

This invention relates to building construction but more particularly relates to air vents used to ventilate rooms or devices within a building to the ambient environment.

BACKGROUND OF THE INVENTION

It is necessary to ventilate buildings, both residential and commercial buildings, to the outside ambient environment. In residential buildings for instance, it may be necessary to ventilate rooms, such as bathrooms to the outside ambient environment, by way of a fan located in the bathroom, which fan exhausts air to the exterior of the building. It is also necessary to vent certain appliances, such as stoves and clothes dryers to the ambient environment. Again, in the case of a stove vent, an exhaust fan is used to exhaust air to the outside. In the case of a clothes dryer, the dryer itself exhausts air to the outside, but may be augmented by an additional exhaust fan.

In industrial buildings, it is also necessary to ventilate rooms such as washrooms, paint rooms and the like, automobile maintenance garages, and so on. It is also necessary to ventilate devices such as commercial dryers, various industrial machinery, and the like.

In any event, it is necessary to terminate the ventilation system that passes through a building wall to the ambient environment, at an exhaust box. Such an exhaust box must allow for the passage of a sufficient amount of exhaust air to the ambient environment, with flow rates ranging perhaps as high as several hundred cubic feet per minute. Further, the exhaust box should preclude physical entry into the ventilation system from the ambient environment of the building. In other words, it should stop birds and small animals from seeking shelter in the ventilation system. Still further, the exhaust box should preclude wind, rain, snow and so on from entering the ventilation system, at least as much as reasonably possible.

Exhaust boxes must also properly seal to the building that they are installed in in order to preclude air and water due to rain, cold weather, snow and so on from entering into the building or leaking into the wall that the exhaust box is in, and to preclude heated or air conditioned air from within the building from unwantedly escaping to the ambient environment.

Further, the exhaust damper should itself have sufficient structural integrity so as to not leak, thereby to preclude air or water from entering into the building or leaking into the wall that the exhaust box is in, and to prevent heated or air conditioned air within the building from unwantedly escaping to the ambient environment.

In order to preclude the passage of air and water due to rain, cold weather, snow and so on, into the interior of the building, an openable and closable damper is employed. Typically, such a damper is gravity biased to a closed position and is moved to an open position by the movement of air therethrough from the interior of the building to the exterior of the building. If wind is present at the exterior of the exhaust box, which wind is directed so as to tend to enter the exhaust box, the damper precludes the wind from passing through the exhaust box. However, the wind resultingly tends to shut the damper more tightly, thereby making it difficult for the normal flow of air that would typically vent through the exhaust box from opening the damper, and thus potentially precluding the normal flow of air from being vented to the exterior of the building.

One type of prior art is an exhaust box that is fabricated from sheet metal. These sheet metal boxes are typically fabricated at the time of installation. Thus, there is no proper uniformity of these boxes and the quality of the boxes depends on the skill of the installer and the care that is taken to construct the box. Typically, these sheet metal boxes leak both air and water back into the building and into the wall that the exhaust box is installed in, and also leak heated or air conditioned air from within the building to the ambient environment. Such leaking occurs because the exhaust boxes do not fit properly into the opening in the wall, because there are openings or gaps in the exhaust box due to poor construction, and because the damper does not close tightly. Further, leaking can occur into the wall structure of the building because of a poor fit between the exhaust damper and the wall structure and also because of gaps in the construction of the sheet metal exhaust damper.

Another type of prior art is an exhaust box that is fabricated from plastic and that has a hinged gravity biased damper that is generally open to the outside and an extension portion that is angled downwardly so as to direct the flow of air downwardly to the exterior of the building and to preclude, at least to some degree, air and water from entering into the exhaust box. When the damper is in its opened position, there is a fairly direct pathway from the interior of the building through the exhaust box into the ambient environment, thus making it possible, if not easy, for air and water to enter through the exhaust box and also for small animals or birds to enter into the exhaust box.

Another problem with typical prior art exhaust boxes is that a plurality of exhaust boxes must be fabricated on a custom fit basis. For exhaust boxes to be installed in juxtaposed relation, it would be necessary that they provide a proper seal between adjacent exhaust boxes so as to preclude the passage of air and water therethrough. Such plastic exhaust boxes are typically used in conjunction with drier exhaust outlets.

It is an object of the present invention to provide an exhaust box that properly seals to the building that it is installed in.

It is another object of the present invention to provide an exhaust box that precludes air and water from entering into the walls of the building it is installed in.

It is yet another object of the present invention to provide an exhaust box that precludes air and water from entering the interior of the building it is installed in.

It is a further object of the present invention to provide an exhaust box that are readily joined one to another so as to form multiple outlets, with proper sealing taking place between adjacent joined exhaust boxes.

It is yet a further object of the present invention to provide an exhaust box that exceeds construction standards for air and water leakage.

SUMMARY OF THE INVENTION

The present invention provides a gravity operated exhaust box for use in a wall structure. The exhaust box comprises a generally rectangular main body portion having an interior end and an exterior end, with the main body portion being adapted to fit into a wall structure such that the interior end is disposed toward the interior of the building defined by the wall structure and the exterior end is disposed toward the exterior of the building defined by the wall structure. An inlet portion extends outwardly from the interior end of the main body portion and is adapted to receive an exhaust duct in generally sealed relation thereto. The inlet portion has a first end terminating exteriorly to the main body portion and a second end terminating interiorly to the main body portion in a damper member receiving surface. A flange portion extends radially outwardly from the exterior end of the main body portion, the flange portion being adapted to interface with the wall structure so as to help retain the exhaust box in place within the wall structure. The main body portion has a sloped bottom portion that is sloped downwardly from the interior end to the exterior end and is thereby adapted to cause water thereon to flow toward the exterior end of the main body portion. A damper member is pivotally attached to the exhaust box such that the damper member is gravity biased into contact with the receiving surface, wherein the receiving surface is adapted to receive the damper member thereagainst so as to substantially preclude the inlet portion from being in fluid communication with the main body portion of the exhaust box. A rain screen grill extends outwardly from the exterior end of the main body portion, wherein the rain screen grill has a generally solid front plate, a generally solid top plate, a bottom plate, and a pair of perforated side plates.

DESCRIPTION OF THE DRAWINGS

Embodiments of the present invention will now be described by way of the accompanying drawings, in which.

DETAILED DESCRIPTION OF THE PREFERRED EMBODIMENTS

Figure 1:
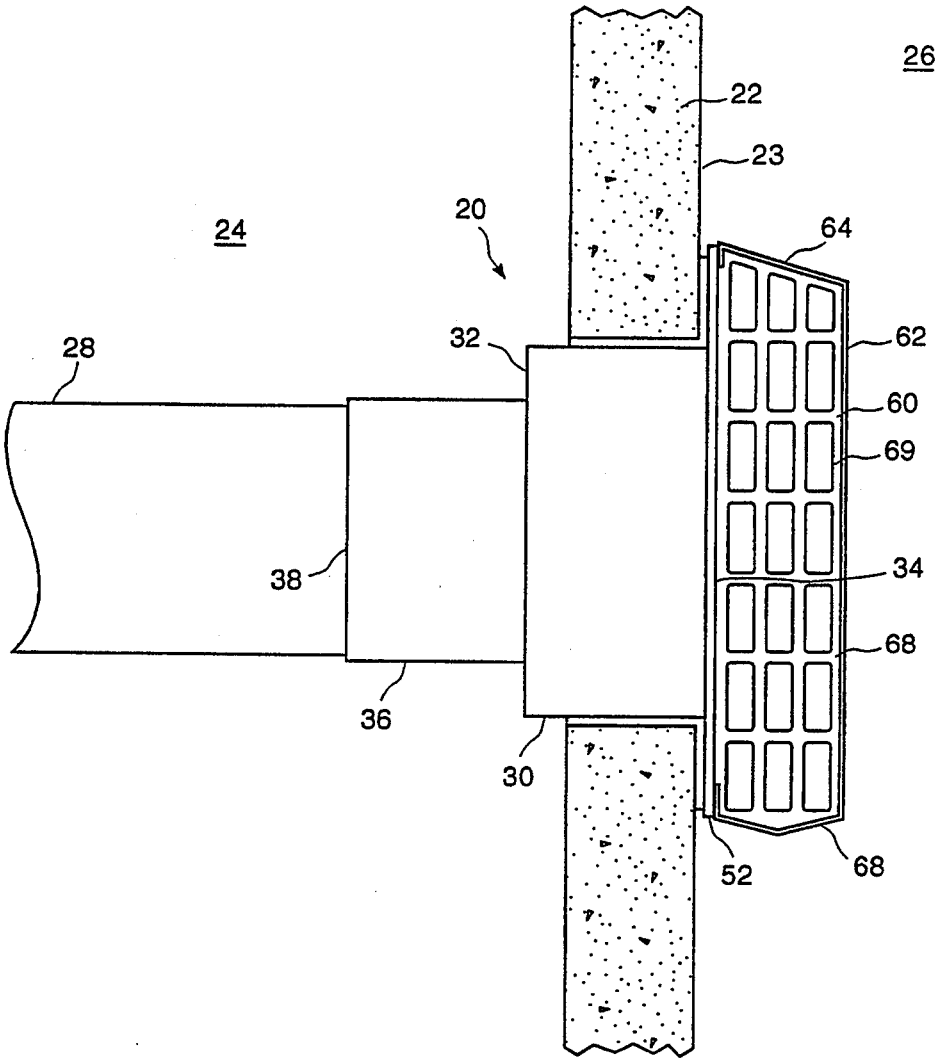
FIG. 1 is a side view of the exhaust box of the present invention installed in a wall structure, with the wall structure shown in sectional view.
Figure 2:
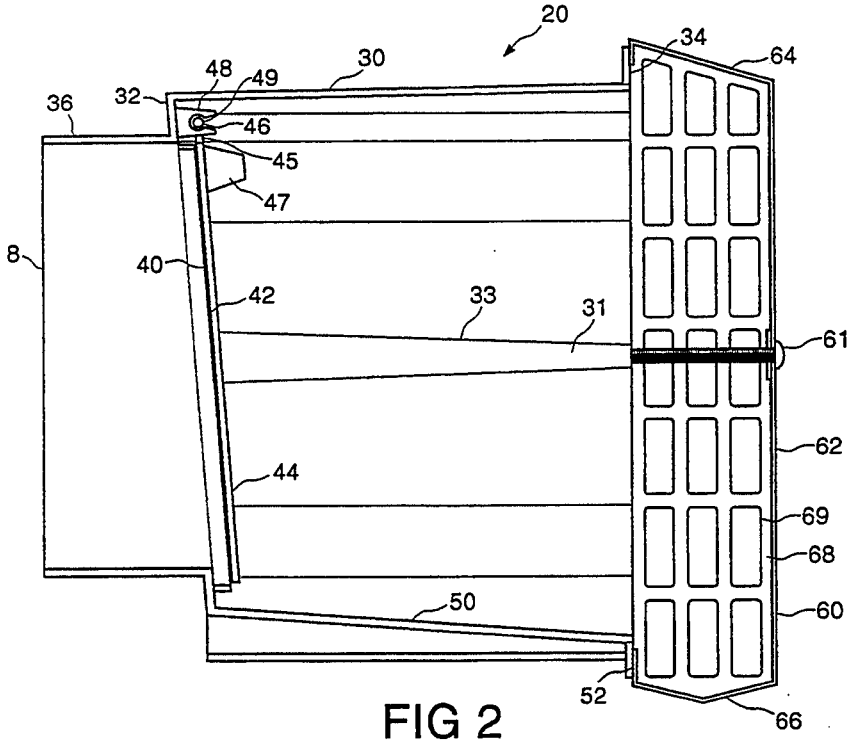
FIG. 2 is a cross-sectional side view of the exhaust box of FIG. 1.
Figure 6:
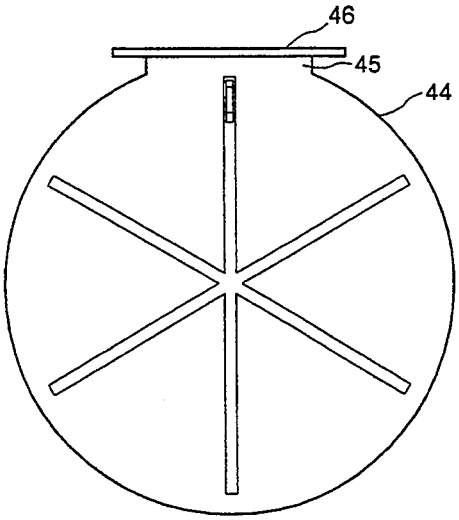
FIG. 6 is a plan view of the damper member.
Figure 5:
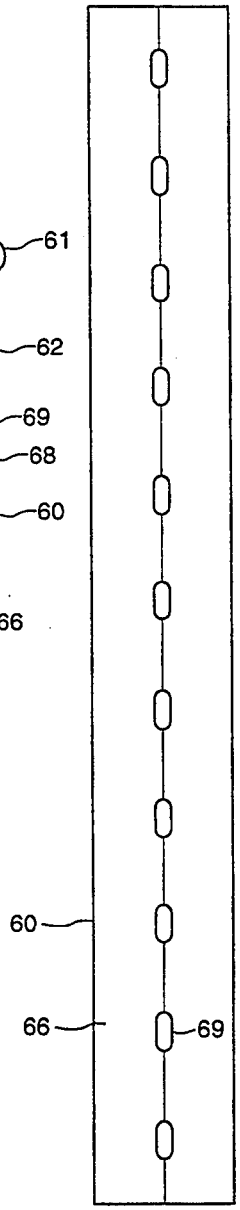
FIG. 5 is a bottom view of the grill portion of the exhaust box of FIG. 1.
Figure 3:
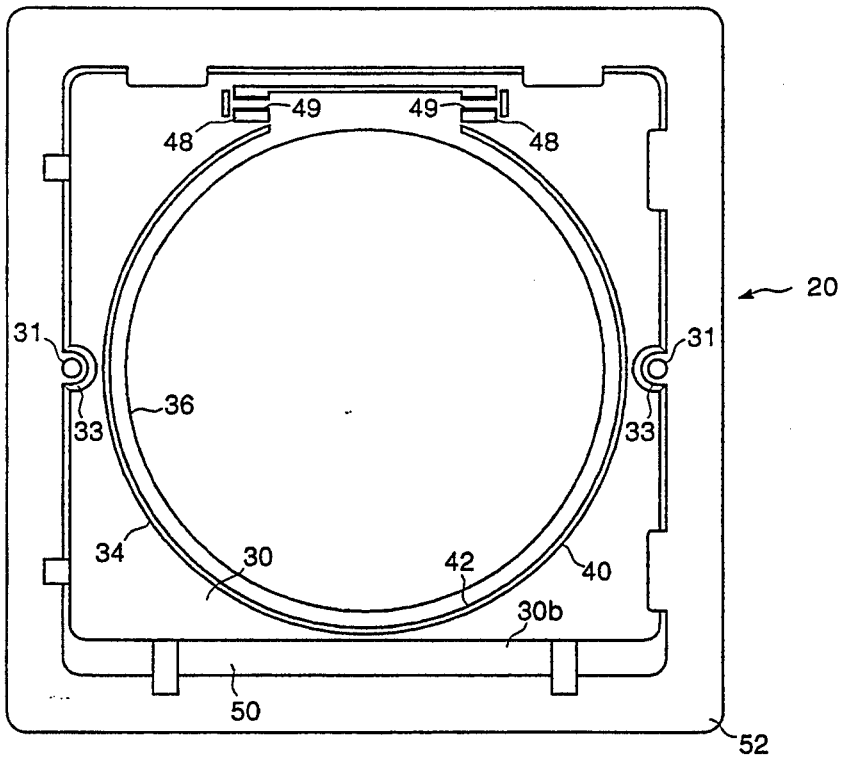
FIG. 3 is a front end view of the exhaust box of FIG. 1 with the damper member removed.
Figure 4:
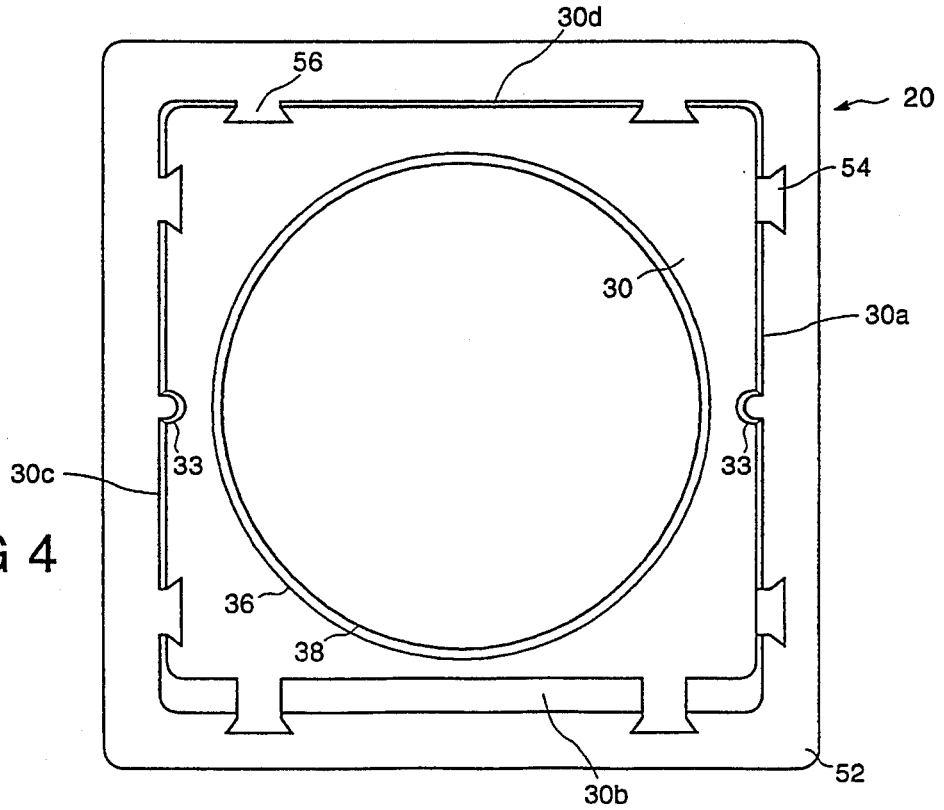
FIG. 4 is a back end view of the exhaust box of FIG. 1, with the damper member removed.

Reference will now be made to FIG. 1, which shows the exhaust box 20 installed within a wall structure 22. The wall structure 22 separates the interior 24 of a structure from the exterior ambient surroundings 26. An exhaust duct 28 is connected in generally sealed relation to the exhaust box 20 as will be described in greater detail subsequently.

The exhaust box 20 has a generally rectangular main body portion 30, which in turn has four opposed wall members 30*a*, 30*b*, 30*c*, and 30*d*. The main body portion 30 is adapted to fit into a co-operating opening in the wall structure 22. When the exhaust box 20 is in place in the wall structure 22, the interior end 32 of the main body portion 30 is disposed toward the interior 24 of the building defined by the wall structure 22 and the exterior end 34 of the main body portion 30 is disposed toward the exterior 26 of the building defined by the wall structure 22.

Extending outwardly from the interior end 24 of the main body portion 30 is an inlet portion 36. This inlet portion 36 is adapted to receive the exhaust duct 28 in generally sealed relation thereto. Preferably, the main body portion 30 and the inlet portion 36 are one integral piece, and are preferably made from a plastic such as polypropylene. The inlet portion 36 is adapted to receive the exhaust duct 28 attached in generally sealed relation thereto.

The inlet portion 36 has a first end 38 that terminates exteriorly to the exhaust box housing, typically within the interior 24 of the building defined by the wall structure 22, and also has a second end 48 that terminates interiorly to the main body portion 30 in a damper member receiving surface 42. The damper member receiving surface 42 is sloped so as to face slightly upwardly at an angle of about 5° with respect to vertical, so that the damper member 44 can more readily rest against it.

A flange portion 52 extends radially outwardly from the exterior end 34 of the main body portion 30. The flange portion 52 is adapted to interface with the outer surface 23 of the wall structure 22 so as to help retain the exhaust box 20 in place within the wall structure 22. Further, normal sealing techniques with caulking or the like, which techniques are well known in the construction industry, are used to properly seal and retain the exhaust box 20 in place within the wall structure 22.

The main body portion 30 has a sloped bottom portion 50 that is sloped downwardly at an angle of about 4° with respect to horizontal from the interior end 32 to the exterior end 34. The sloped bottom portion is thereby adapted to cause any water thereon to flow toward the exterior end 34 of the main body portion 30, so as to ultimately exit the main body portion 30 and ultimately exit the exhaust box 20.

A generally circularly shaped damper member 44 is pivotally attached to the exhaust box 20, preferably at the interior of the main body portion 30, by way of a pair of pivot members 46, which are coaxially aligned with one another and which extend outwardly from the base portion 45 of the damper member 44. The pivot members 46 are received in pivotal relation in a co-operating pair of support members 48, each of which have an aperture 49 located therein, which apertures 49 are slightly larger in diameter than a diameter of the pivot members 46. The receiving surface 42 is adapted to receive the damper member 44 thereagainst in partially sealed, relation thereto so as to substantially preclude the inlet portion 36 from being in fluid communication with the main body portion 30 of the exhaust box housing 20. The damper member 44 is gravity biased into contact with the receiving surface 42 by virtue of the fact that the pivot members 46 are offset rearwardly with respect to the center plane of the generally planar damper member 44 and also due to the placement of the apertures 49 in the support members 48 and also due to the slightly upward orientation of the damper member receiving surface 42. The damper member 44 may include a plurality of radially extending reinforcing ribs 43, which are preferably generally evenly spaced around the damper member 44. There is also a rib 47 that is adapted for contact with the main body portion 30 of the exhaust box 20, to thereby preclude the damper from opening too far. While the rib 47 is included in the preferred embodiment, its inclusion is not necessary.

A removably attachable rain screen grill extends outwardly from the exterior end 34 of the main body portion 30, and is attached by way of a pair of threaded members 61, which are received in co-operating threaded apertures within the respective extended threaded socket extensions 33, to the main body portion 30 of the exhaust box 20. The rain screen grill 60 has a generally solid front plate 62, a generally solid top plate 64, a bottom plate 66 and a pair of perforated side plates 68. The front plate 62 and the top plate 64 are generally solid so as to preclude weather elements, such as wind and rain and snow, from entering the exterior end 34 of the main body portion 30. The bottom plate 66 is preferably a "V" shaped trough and has a plurality of perforations therein for allowing any water that might enter the rain screen grill 60 or condense in the rain screen grill 60 or in the main body portion 30 to exit from the rain screen grill 60. Further, these perforations 67 allow for the passage of air being expelled by the exhaust box 20. The perforated side plates 68 have a plurality of perforations 69 therein. These perforations are to allow for the passage of air being exhausted through the exhaust box 20.

Extending outwardly from the two wall members 30*a*, 30*b* of the main body 30, are male dovetail connecting portions 54, which are formed as part of the exhaust box 20. Extending inwardly into the main body portion 30 in the two wall members 30*c*, 30*d* are co-operating female dovetail connecting portions 56. These male and female dovetail connecting portions 54, 56 are adapted to interconnect one with another such that a plurality of exhaust boxes may be connected one to the other in side-to-side or top-to-bottom relation.

Figure 7:
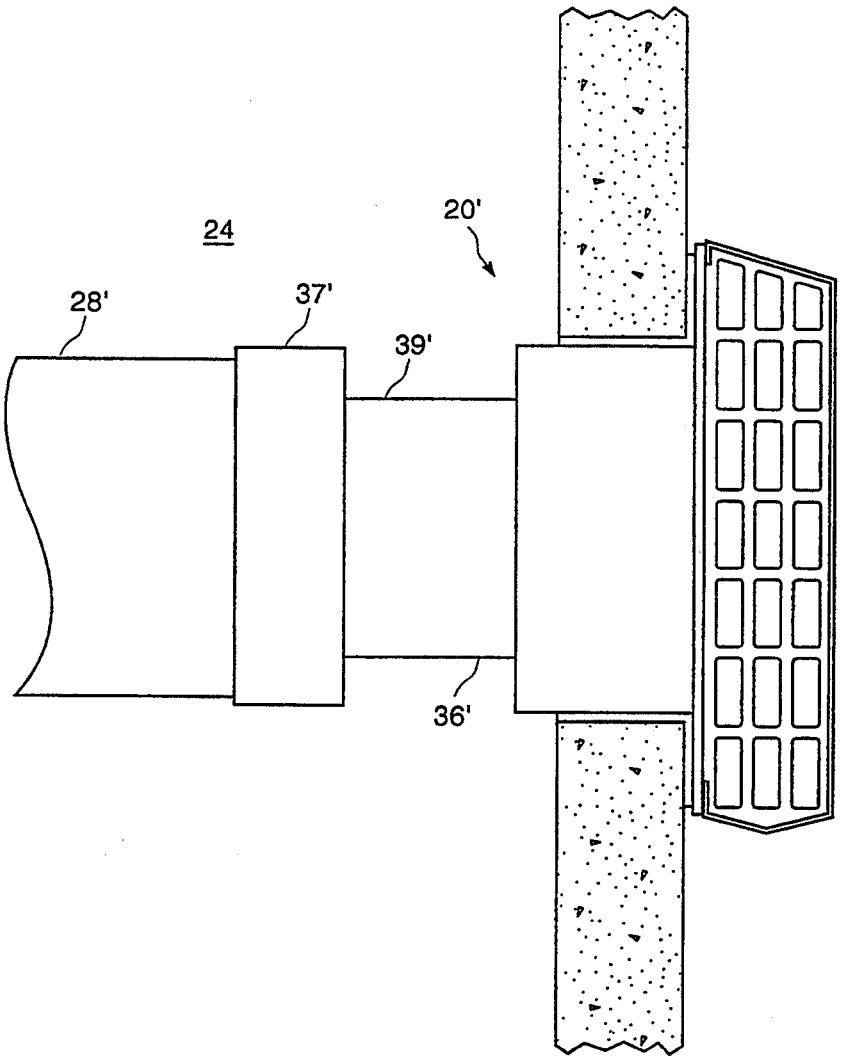
FIG. 7 is a side view of an alternative embodiment of the present invention installed in a wall structure, with the wall structure shown in section view.

In an alternative embodiment, as shown in FIG. 7, the inlet portion 36', of the exhaust box 20', has a wider portion 37' and a narrower portion 39'. The inlet portion 36' is thereby adapted to receive either of two different diameter exhaust ducts in sealed relation thereto. As shown in FIG. 7, the exhaust duct 28' is attached to the wider portion 37' of the inlet portion 36'. The wider portion 37' of the inlet portion 36' is adapted to receive a wider exhaust duct 28', than the exhaust duct 28 shown in FIG. 1.

In an alternative embodiment, the rain screen grill of a double width is contemplated, which double width rain screen grill would be removably attachable to a pair of exhaust boxes that are connected together in side-to-side or top-to-bottom relation by way of the male and female dovetail connecting portions.

Other modifications and alterations may be used in the design and manufacture of the improved exhaust box of the present invention without departing from the spirit and scope of the accompanying claims.

What is claimed is:

1. A gravity operated exhaust box for use in a wall structure, said exhaust box comprising:

a generally rectangular main body portion having an interior end and an exterior end, and adapted to fit into a wall structure such that said interior end is disposed toward the interior of the building defined by said wall structure and said exterior end is disposed toward the exterior of the building defined by said wall structure;

an inlet portion extending outwardly from said interior end of said main body portion and adapted to receive an exhaust duct in generally sealed relation thereto, said inlet portion having a first end terminating exteriorly to said main body portion and a second end terminating interiorly to said main body portion in a damper member receiving surface;

a flange portion extending radially outwardly from said exterior end of said main body portion, said flange portion being adapted to interface with said wall structure so as to help retain said exhaust box in place within said wall structure;

said main body portion having a sloped bottom portion that is sloped downwardly from said interior end to said exterior end and is thereby adapted to cause water thereon to flow toward said exterior end of said main body portion;

a damper member pivotally attached to said exhaust box such that said damper member is gravity biased into contact with said receiving surface, wherein said receiving surface is adapted to receive said damper member thereagainst so as to substantially preclude said inlet portion from being in fluid communication with said main body portion of said exhaust box; and a rain screen grill extending outwardly from said exterior end of said main body portion, wherein said rain screen grill has a generally solid front plate, a generally solid top plate, a bottom plate, and a pair of perforated side plates with said plates generally enclosing said exterior end of said main body portion such that there are substantially no gaps between said plates and said main body portion.

2. The exhaust box of claim 1, wherein said rain screen grill is removable attachable by way of at least one threaded member.

3. The exhaust box of claim 2, wherein said main body portion and said inlet portion are one integral piece.

4. The exhaust box of claim 3, wherein said exhaust box is made from polypropylene.

5. The exhaust box of claim 4, wherein said receiving surface is sloped so as to face slightly upwardly.

6. The exhaust box of claim 5, wherein said bottom plate of said rain screen grill is trough shaped and has at least one perforation therein so as to allow for drainage of water therefrom.

7. The exhaust box of claim 1, wherein said sloped bottom portion is sloped at an angle of about 4° with respect to horizontal.

8. The exhaust box of claim 1, wherein said receiving surface is sloped at an angle of about 5° with respect to vertical.

9. The exhaust box of claim 1, wherein said inlet portion comprises a wider portion and a narrower portion, and is thereby adapted to be connected to a plurality of different diameter ducts.

10. The exhaust box of claim 1, wherein said exhaust box has a plurality of male and female dove tail connecting portions formed in therein that are adapted to interconnect one with another such that a plurality of said exhaust boxes may be connected one to the other.

* * * * *